United States Patent [19]

Natsui et al.

[11] 4,160,888

[45] Jul. 10, 1979

[54] PUFFER-TYPE GAS-BLAST CIRCUIT BREAKER

[75] Inventors: Ken-ichi Natsui; Kunio Hirasawa; Yoshio Yoshioka; Hiroshi Chida, all of Hitachi, Japan

[73] Assignee: Hitachi, Ltd., Tokyo, Japan

[21] Appl. No.: 802,940

[22] Filed: Jun. 2, 1977

[30] Foreign Application Priority Data

Jun. 10, 1976 [JP] Japan ..... 51/67987
Jun. 10, 1976 [JP] Japan ..... 51/67989

[51] Int. Cl.[2] ..... H01H 33/70; H01H 33/88
[52] U.S. Cl. ..... 200/148 A; 200/150 G
[58] Field of Search ..... 200/148 A, 150 G, 148 R

[56] References Cited

U.S. PATENT DOCUMENTS

| | | | |
|---|---|---|---|
| 2,442,010 | 5/1948 | Leeds et al. | 200/150 G |
| 2,933,575 | 4/1960 | Baker | 200/148 A |
| 3,987,261 | 10/1976 | McConnell | 200/150 G |

FOREIGN PATENT DOCUMENTS

| | | | |
|---|---|---|---|
| 1262408 | 3/1968 | Fed. Rep. of Germany | 200/148 A |

*Primary Examiner*—Robert S. Macon
*Attorney, Agent, or Firm*—Craig and Antonelli

[57] ABSTRACT

A puffer type gas-blast circuit breaker includes at least one interrupting unit mounted in a vessel filled with an arc-extinguishing gas of a unitary pressure. The interrupting unit comprises: a fixed contact; a movable contact movable toward and away from the fixed contact to be engaged with and to be disengaged from the fixed contact respectively, the movable contact having an axial hollow portion, wherein an arc is established between the contacts upon disengagement of the movable contact from the fixed contact; an insulating nozzle encompassing a free end portion of the movable contact and having a throat portion therein, which is substantially closed with the fixed contact; a compression chamber filled with an arc extinguishing gas; a suction chamber, wherein an arc extinguishing gas within the compression chamber is compressed and the volume of the suction chamber is enlarged upon movement of the movable contact away from the fixed contact, whereby a pressure difference between the compression chamber and the suction chamber causes the arc extinguishing gas to be directed from the compression chamber through the axial hollow portion into the suction chamber thereby to be blown against an arc produced between the fixed contact and the movable contact; and the suction chamber is brought into an open condition to or communication with a space in the vessel, simultaneously when the fixed contact is drawn out of the throat portion in the insulating nozzle.

16 Claims, 15 Drawing Figures

PUFFER-TYPE GAS-BLAST CIRCUIT BREAKER

This invention relates to a puffer type gas-blast circuit breaker, and more particularly to a circuit breaker of the type described, which includes a compression chamber and a suction chamber, and in which a pressure difference between the compression chamber and the suction chamber causes an arc extinguishing gas to be blown against an arc produced between the contacts.

A puffer type gas-blast circuit breaker is known as a small-size, large-capacity circuit breaker of a simple construction.

A prior art puffer type gas-blast circuit breaker includes at least one interrupting unit mounted in a vessel filled with an arc extinguishing gas such as an $SF_6$ gas of a unitary pressure. The interrupting unit includes a pair of contacts which are positioned in alignment with but in opposed relation to each other and movable toward and away from each other so as to be engaged with and to be disengaged from each other, respectively. At least one of the contacts has therein an axial hollow portion. The interrupting unit further includes a compression chamber filled with an arc extinguishing gas, and an suction chamber. When a pair of contacts move away from each other, the arc extinguishing gas in the compression chamber is compressed, and the volume of the suction chamber is enlarged. When a pair of contacts are disengaged from each other, then the compression chamber and the suction chamber communicate with each other through the axial hollow portion of the one contact, so that a pressure difference between the compression chamber and the suction chamber causes an arc extinguishing gas from the compression chamber to be directed into the suction chamber so as to be blasted against an arc produced between the pair of contacts, thereby extinguishing the arc.

According to the aforesaid prior art puffer type gas-blast circuit breaker, there may be obtained a large pressure difference between the compression chamber and the suction chamber and hence an arc extinguishing gas may be effectively blown against an arc produced between the both contacts, and hence an arcing time may be shortened. However, in the terminating phase of an opening operation of a pair of contacts, an arc produced between the both contacts heats an extenguishing gas, which in turn is introduced into the suction chamber, so that a pressure in the suction chamber is increased as compared with the pressure of gas filled in the vessel. In the above case, there results lack of pressure difference between the compression chamber and the suction chamber, so that the flow velocity of gas being blown against an arc produced between contacts is lowered. In case a pressure in the suction chamber becomes higher than a pressure within the vessel, then a blowing effect of an arc extinguishing gas on the arc is impaired, with the resulting lowered interrupting-performance of the breaker.

It is an object of the present invention to provide a puffer type gas-blast circuit breaker, which prevents the pressure rise in a suction chamber to a level higher than that in a space in a vessel, by bringing the suction chamber into an open condition to or communication with a space in a vessel, at the terminating stage of an opening operation of a pair of contacts.

According to the present invention, there is provided a puffer type gas-blast circuit breaker having at least one interrupting unit mounted in a vessel filled with an arc extinguishing gas of a unitary pressure, the aforesaid interrupting unit comprising: a pair of contacts positioned in alighment with but in opposed relation to each other, and movable toward and away from each other to be engaged with and to be disengaged from each other respectively, at least one of the pair of contacts having therein an axial hollow portion, said hollow portion having an opening in that axial free end of the aforesaid at least one contact which is opposed to the end of the other contact, wherein an arc is established between said pair of contacts upon disengagement of the pair of contacts from each other; a first cylinder and a first piston within the first cylinder to define a compression chamber filled with an arc extinguishing gas, said first piston and cylinder being movable relative to each other in association with the relative movement of said pair of contacts; an insulating nozzle encompassing a free end portion of one of the aforesaid pair of contacts, and having a throat portion in alignment with a pair of the contacts, the aforesaid throat portion being substantially blocked with the other contact, the insulating nozzle having an inner peripheral surface which defines a guide passage by the cooperation of an outer peripheral surface of the free end portion of the aforesaid one contact, and the aforesaid guide passage bringing the compression chamber through the opening into communication with the axial hollow portion, when the aforesaid pair of contact are disengaged from each other; a second cylinder and a second piston within said second cylinder to define a suction chamber, the aforesaid second piston and cylinder being movable relative to each other in association with the relative movement of said pair of contacts; a first communicating means for communicating the compression chamber with the axial hollow portion; whereby when said pair of contacts are moved away from each other to be disengaged from each other, an arc extinguishing gas in the compression chamber is compressed and a volume of the suction chamber is enlarged, and a pressure difference between the compression chamber and the suction chamber causes an arc extinguishing gas to be directed from the compression chamber via the guide passage, the axial hollow portion, and the first communicating means into the suction chamber to blow against an arc produced between the pair of contacts; and gas bleeding means for allowing communication of the suction chamber with a space within the vessel for bleeding an arc extinguishing gas from the suction chamber into the vessel, when the pair of contacts move a fixed distance in the opposite directions away from each other.

According to the circuit breaker of the present invention, both of a pair of contacts may be relatively moved or one of a pair of the contacts is movable and the other may be fixed. In addition, a pair of the contacts may both have axial hollow portions.

Still alternatively, both of the first cylinder and the first piston may be moved, or one of them is movable and the other may be fixed. In this case, one of them may be allowed to be coupled to a contact. Likewise, both of the second cylinder and the second piston may be moved, or one of them is movable and the other is fixed. In this case, one of them may be allowed to be coupled to a contact.

Figure 1:
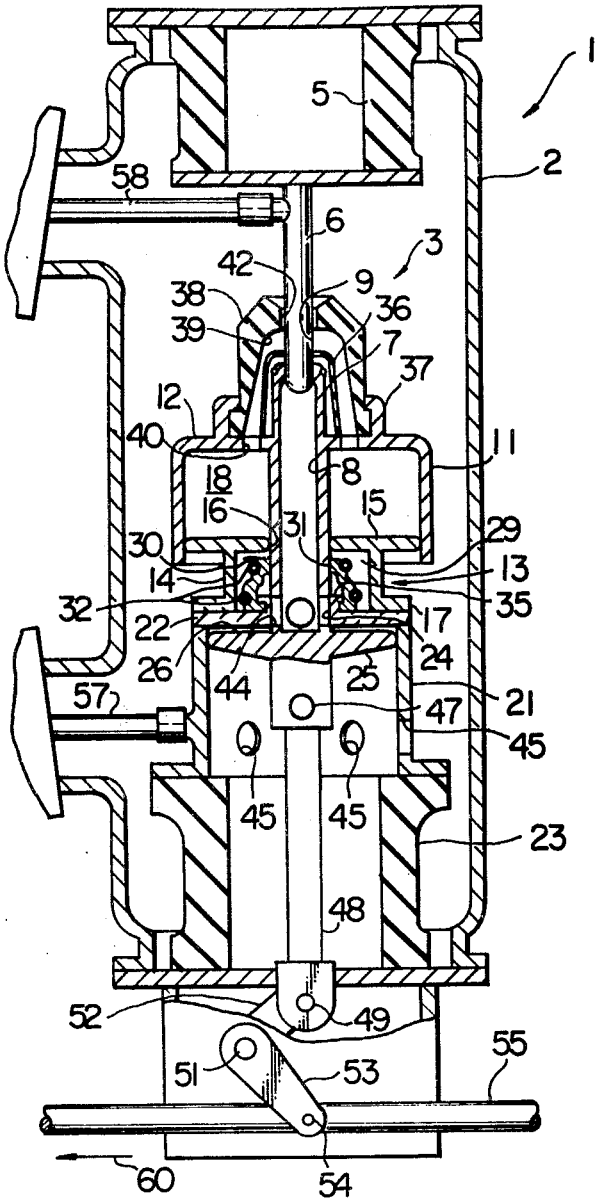
FIG. 1 is a cross-sectional view of a puffer type gas-blast circuit breaker according to the present invention, in its closed circuit condition.

Referring to FIG. 1, there is generally shown at 1 a puffer type gas-blast circuit breaker according to the present invention. The circuit breaker 1 includes a vessel 2 filled with an arc extinguishing gas of a unitary pressure, and at least one interrupting unit 3 mounted in the vessel 2. The interrupting unit 3 includes a solid fixed contact 6 which is secured through the medium of a tubular insulating member 5 to the vessel 2, and a movable contact 7 in alignment with but in opposed relation to the fixed contact 6 and movable in the direction towards and away from the fixed contact 6 so as to be engaged with and to be disengaged from the fixed contact 6, respectively. The movable contact 7 includes therein an axial hollow portion 8 having an opening 9 which opens in that axial free end face of the movable contact 7 which is opposed to the fixed contact 6. When the circuit is in its closed position, the opening 9 is closed with the fixed contact 6.

A first cylinder 11 has a substantially closed end 12 and is integrated with the movable contact 7 in a manner that the movable contact 7 extends through the substantially closed end 12 of the first cylinder 11 in concentric relation therewith. A first piston assembly 13 is slidably fitted in a first cylinder 11. The first piston assembly 13 includes: a cylindrical member 14, a ring-shaped piston member 15 secured to one end of the cylindrical member 14 and having an outer peripheral surface which is slidably sealingly fitted in the first cylinder 11, and an inner peripheral surface defining a hole 16; and a flange 17 secured to the other end of the cylindrical member 14. A compression chamber 19 is defined by a substantially closed end portion 12 of the first cylinder 11, and ring shaped piston member 15 fitted therein sealingly slidably and inner peripheral surface of the first cylinder 11, and outer peripheral surface of a movable contact 7.

A second cylinder 21 is secured through the medium of a tubular insulating body 23 to a vessel 2. One end portion 22 of the second cylinder 21 is provided with a hole 24 positioned in concentric relation thereto, with the movable contact 7 being fitted in the hole 24 sealingly slidably. A second piston 25 is fitted in the second cylinder 21 sealingly slidably, and integrally secured to one end of the movable contact 7 on a side opposite to its free end portion. Thus, a suction chamber 26 is defined by the end 22 of the second cylinder 21, second piston 25, inner peripheral surface of second cylinder, and outer peripheral surface of the movable contact 7.

The flange 17 of the first piston assembly 13 is secured to the surface of end portion 22 of the second cylinder on a side opposite to the suction chamber 26. Thus, a chamber 29 is defined by the end portion 22 of the second cylinder 21, ring-shaped piston member 15, inner peripheral surface of the cylindrical member 14, and outer peripheral surface of the movable contact 7. A collector 30 is provided with a hole 31, while the inner peripheral surface of the hole 31 is urged against the outer peripheral surface of the movable contact 7 under the action of springs 32. The collector 30 is formed with a flange extending in the radial direction inwardly and engages a flange 35 secured to the end portion 22 of the second cylinder 21 on a side opposite to the suction chamber and extending around a circumference of the hole 24 in the end portion 22. Secured to the substantially closed end portion 12 of the first cylinder 11 on a side opposite to the compression chamber 18 is an insulating cover 36 which encompasses free end portion of the movable contact 7. Disposed on the side opposite to the compression chamber with respect to the substantially closed end 12 of the first cylinder 11 is an annular flange 37 which is integrated with the end 12. An insulating nozzle 38 is secured to the annular flange 37 in a manner to surround the insulating cover 36. An arc-extinguishing gas guide passage 39 is defined between the inner peripheral surface of the insulating nozzle 38 and the outer peripheral surface of the insulating cover 36, and is communicated through holes 40 provided in the substantially closed end 12 of the first cylinder 11 with the compression chamber 18. Thus, when the movable contact 7 is disengaged from the fixed contact 6, the compression chamber 18 is communicated via holes 40, passage 39 and opening 9 with the axial hollow portion 8 in the movable contact 7.

The insulating nozzle 38 is formed with a throat portion 42 which is positioned in coaxial relation to the fixed contact 6. The throat portion 42 in the insulating nozzle 38 is capable of being blocked by the fixed contact 6. An opening 44 is provided in an end peripheral wall of the movable contact 7 on a side opposite to the free end portion thereof, so that the axial hollow portion 8 is brought into communication with the suction chamber 26 through the opening 44, when the movable contact 7 is moved in the direction away from the fixed contact 6.

Openings 45 are formed in the peripheral wall of the second cylinder 21, and the suction chamber 26 may be communicated with a space within the vessel 2, when that surface of the second piston 21 opposite to the substantially closed end 22 of the second cylinder 21 overlaps the openings 45. The position of the openings 45 is such that, as will be described hereinafter, when the movable contact 7 is moved a given distance from the fixed contact 6, the suction chamber 26 may be communicated with a space in the vessel 2 through the openings 45.

The piston 25 is connected to a connecting member 48 by means of a pin 47, and the connecting member 48 is connected to one arm 52 of a 'L' shaped link by means of a pin 49, while the 'L' shaped link is pivotally supported by a pin 51. The other arm 53 of the 'L' shaped link is pivotally connected to a driving rod 55 by means of a pin 54, and the driving rod 55 in turn is connected to an actuator not shown. One terminal 57 is coupled to the outer peripheral surface of the second cylinder 21, while the other terminal 58 is coupled to the fixed contact 6.

Description will now be given of an interrupting operation of the breaker, hereunder. FIG. 1 shows an interrupting unit 3 in a closed circuit condition.

Figure 2:
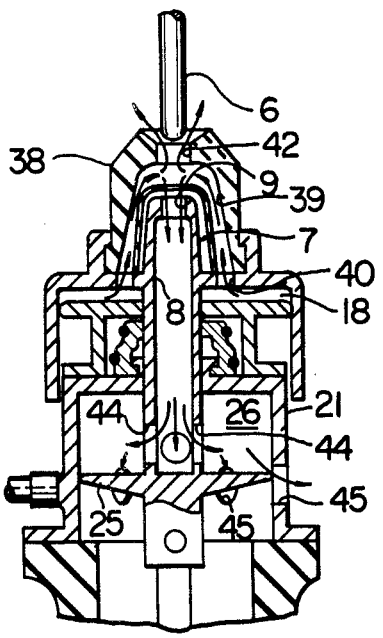
FIG. 2 is a cross-sectional view illustrating a part of the circuit breaker of FIG. 1, in its open circuit condition.

An actuator means not shown is operated to move the driving rod 55 in an arrow direction 60. According to the movement of the driving rod 55, arms 52, 53 of an 'L' shaped link are moved in the direction to keep the movable contact 7 away from the fixed contact 6 through the medium of a connecting member 48. The movement of the movable contact 7 in the direction away from the fixed contact 6 causes the first cylinder 11 integrated with the movable contact 7 to move in the direction towards the first piston 11 as well as causes the second piston 25 integrated with the movable contact 7 to move in the direction away from the substantially closed end 22 of the second cylinder 21. As a result, an arc extinguishing gas within the compression chamber 18 is compressed, and the volume of the suction chamber 26 is enlarged, resulting in a large pressure difference between the compression chamber 18 and the suction chamber 26. As shown in FIG. 2, when the movable contact 7 is disengaged from the fixed contact 6, a pressure difference between the compression chamber 18 and the suction chamber 26 causes an arc extinguishing gas in the compression chamber 18 to be directed through the hole 40 in the substantially closed end 12 of the first cylinder 11, guide passage 39, and opening 9, into the axial hollow portion 8 and then through the holes 44 provided in the peripheral wall of the movable contact 7 into the suction chamber 26. When an arc extinguishing gas flows from the compression chamber 18 through the passage 39 and opening 9 into the axial hollow portion 8, the arc extinguishing gas is blown against an arc produced between the movable contact 7 and the fixed contact 6, so that the arc is extinguished. When a current to be interrupted reaches its current zero point, before the fixed contact 6 is drawn out of the throat portion 42 in the insulating nozzle 38, an arc is extinguished. More particularly, a difference in pressure between the compression chamber 18 and the suction chamber 26 produces strong arc extinguishing gas streams, which are blown against an arc produced between the contacts 6 and 7.

In case an arc can not be extinguished by a gas stream directed from the compression chamber 18 to the suction chamber 26, a gas stream flowing through the throat portion 42 in the insulating nozzle extinguishes an arc in cooperation with the firstly referred gas stream. A volume of the suction chamber 26 is so selected that a gas stream be delivered from the compression chamber 18 to the suction chamber 26, until the fixed contact 6 is drawn out of the throat portion 42 in the insulating nozzle 38, although the volume of the suction chamber 26 varies depending on a current capacity.

In case the suction chamber 26 is so designed as to be isolated from an ambient gas contained in a space in the vessel 2 until its reaching an open position, even after the fixed contact 6 has been drawn out of the throat portion 42 in the insulating nozzle 38, then gas heated by an arc produced between the contacts 6, 7 is introduced from the compression chamber into the suction chamber 26, so that a pressure in the suction chamber is built up to a level higher than that of the ambient gas in the vessel 2, thus resulting in a reduced difference in pressure between the compression chamber 18 and the suction chamber 26, thereby failing to provide a gas stream to be blown against an arc, which stream runs from the compression chamber through the axial hollow portion 8 in the contact 7 into the suction chamber 26. To avoid this, there is provided a gas bleeding means for bleeding the gas from the suction chamber into the ambient gas space, soon after or when the fixed contact 6 has been drawn out of the throat portion in the insulating nozzle 38. In the embodiments shown in FIGS. 1 and 2, the aforesaid gas bleeding means is provided in the form of openings provided in the peripheral wall of the second cylinder 21. In other words, soon after or when the fixed contact 6 has been drawn out of the throat portion 42 in the insulating nozzle 38, the second piston 25 reaches the opening 45. As a result, the suction chamber 26 is communicated or open through the openings 45 with or to ambient gas space, so that a pressure in the suction chamber 26 is no longer built up or maintained at the same level to that of ambient gas.

When the fixed contact 6 is drawn out of the throat portion 42 in the insulating nozzle 26, then an arc extinguishing gas compressed in the compression chamber 18 is discharged through the throat portion 42 into the vessel 2, and thus there are produced gas streams directed towards the fixed contact 6 as well as towards the movable contact 7 in the directions opposite to each other, so that an arc produced between the both contacts can be extinguished certainly.

Figure 3:
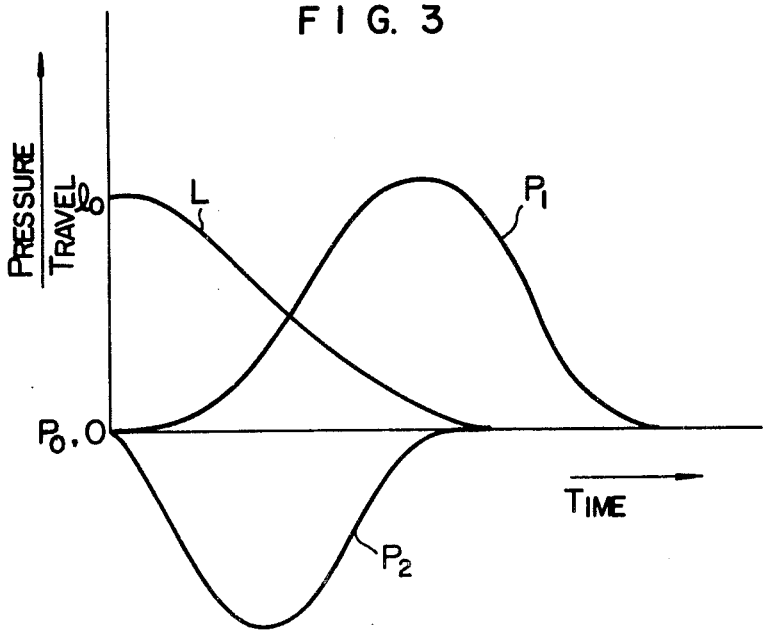
FIG. 3 is a contact travel versus-pressure characteristics of the circuit breaker of FIG. 1.

FIG. 3 is a diagram showing the relationship among a travel (L) of the movable contact, a pressure (P1) in the compression chamber 18, and a pressure (P2) in the suction chamber 28, upon the current interruption of a puffer type gas-blast circuit breaker according to the present invention.

Figure 4:
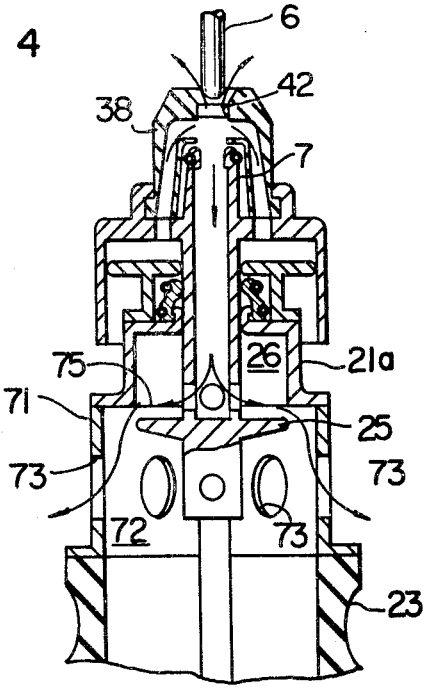
FIG. 4 is a partial cross-sectional view showing a modification of gas bleeding means.

As can be seen from FIG. 3, since an arc extinguishing gas heated by the arc, which has been introduced into the suction chamber, soon after or when the fixed contact 6 is drawn out of the throat portion 42 in the insulating nozzle 38, in the terminating stage of an opening operation of contacts, is bled through the openings 45 into a space in the vessel 2, a pressure (P2) in the suction chamber 28 may be maintained lower than a pressure (P0) in the vessel 2, thereby maintaining a large pressure difference between the compression chamber 18 and the suction chamber 26. FIG. 4 shows a modification of the aforesaid gas bleeding means, with the similar parts designated same reference numerals in common with those given in FIG. 1. Referring to FIG. 4, a flange of a second cylinder 21*a* is coupled through the medium of a cylindrical member 71 to a tubular insulating body 23. A space 72 defined by the inner peripheral surface 71 is communicated through an opening provided in the peripheral wall of the cylindrical member 71 with a space in the vessel 2. The space 72 is continuous with a suction chamber 26 along a joint of the second cylinder 21a to the cylindrical member 71, and has a diameter larger than the diameter of the suction chamber 26. A joint 75 between the suction chamber 26 having a small diameter and the space 72 having a large diameter and positioned in opposed relation thereto are so located that the second piston 25 may reach the joint 75 soon after or when the fixed contact 6 is drawn out of the throat portion 42 in the insulating nozzle 38. In this manner, the suction chamber 26 is brought into communication with the space 72, soon after or when the fixed contact 6 is drawn out of the throat portion in the insulating nozzle 38, so that gas is bled from the suction chamber 26 by way of the opening 73 into a space in the vessel 2.

Figure 5:
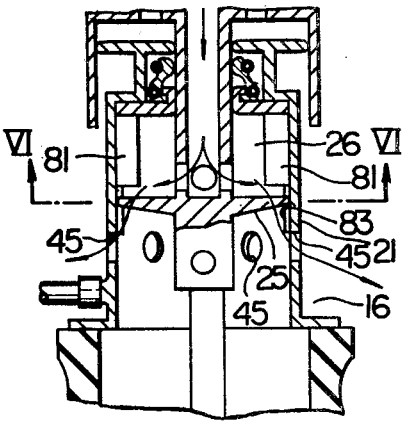
FIG. 5 is a partial cross-sectional view showing another modification of the gas bleeding means.
Figure 6:
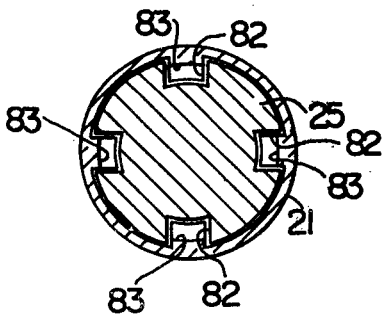
FIG. 6 is a cross-sectional view taken along the line VI—VI of FIG. 5.
Figure 7:
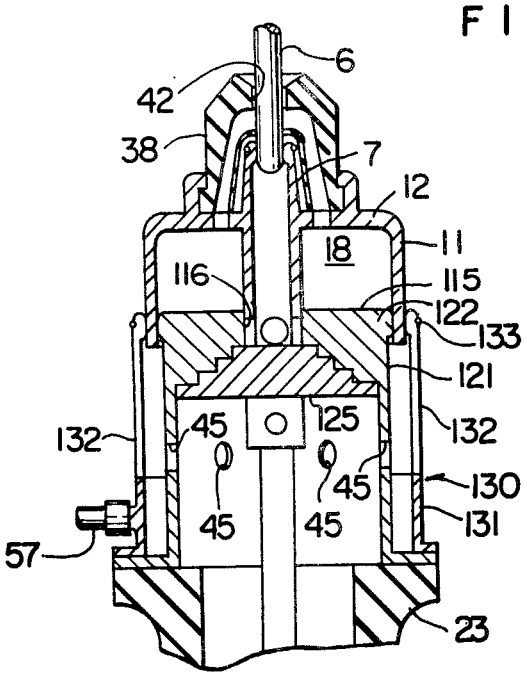
FIG. 7 is a partial cross sectional view of another embodiment of the invention, in its closed circuit condition.
Figure 8:
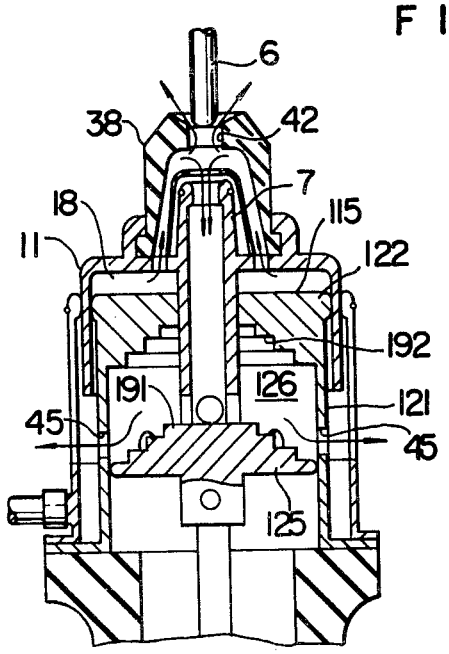
FIG. 8 is a partial cross-sectional view of the circuit breaker of FIG. 7, in its open circuit condition.

FIGS. 5 and 6 show another modification of the gas bleeding means, with the similar parts designated same reference numerals in common with those given in FIG. 1. Referring to FIGS. 5 and 6, elongated members 81 are secured to or integrally coupled to the inner peripheral surface of the second cylinder 21 at an equal spacing in the circumferential direction around the axis of the second cylinder. Cut-away portion 82, whose shapes are complementary to the aforesaid elongated members, are defined in the peripheral surface of the second cylinder 25. Thus, the elongated members 81 are slidably sealingly fitted in the cut-away portions 82. In a closed circuit condition, the cut-away portions 82 are blocked with elongated members 81. Upon a circuit-opening operation, the elongated members 81 are drawn out of cut-away portions 82, soon after or simultaneously when the fixed contact is drawn out of the throat portion in the insulating nozzle, with the result that the suction chamber 26 is open to or communicated with a space in the vessel. For certain bringing the elongated members 81 into engagement with the cut-away portions 82 in the second piston 25, in a closed circuit condition, guide portions 83 are provided in the inner surface of the second cylinder 21. The guide members 83 are fitted in the cut-away portions 82 in the second piston for guiding the movement thereof. Apparently, it is preferable that an initial volume of a space in the suction chamber and a volume associated herewith be minimized, thereby enhancing a vacuum effect in the suction chamber at the initial stage of a circuit opening operation to increase a pressure difference between the compression chamber and the suction chamber. For the purpose of this, after a circuit opening operation, it is preferable that a volume, or a dead volume, in the axial hollow portion in the movable contact, which is communicated with the suction chamber, be minimized. Stated differently, it is preferable that the suction chamber be positioned close to the compression chamber. FIGS. 7 and 8 show another embodiment of the invention, in which a collector 30 shown in FIG. 1 is eliminated to bring the suction chamber closer to the compression chamber, thereby minimizing a volume in the axial hollow portion in the movable contact. In these figures, the similar parts are designated same reference numerals in common with those given in FIG. 1.

Referring to FIGS. 7 and 8, a second cylinder 121 having a substantially closed end portion 122 is secured through the medium of an insulating body 23 to a vessel as in the manner shown in FIG. 1. The substantially closed end portion 122 of the second cylinder 121 is sealingly slidably fitted in a first cylinder 11, so that the substantially closed end portion 122 may define a first piston 115. The first piston 115 is provided with a hole 116 positioned in concentric relation thereto, with a movable contact 7 fitted in the hole 116 sealingly slidingly. Thus, a compression chamber 18 is defined by the substantially closed end portion 122, first piston 115, inner peripheral surface of the first cylinder 115, and outer peripheral surface of the movable contact 7.

In the embodiment shown in FIGS. 7 and 8, a cylindrical collector 130 is used in place of the collector 30 of FIG. 1. The collector 130 includes a cylindrical member 131 and two or more contacting pieces 132 extending from one axial end of the cylindrical member 131 towards the fixed contact 6. The two or more contacting pieces 132 are positioned at an equal spacing in the circumferential direction of the cylindrical member 131. A free end of each contacting piece 132 is urged against the outer peripheral surface of the first cylinder 11 under the action of a spring 133. The collector 130 has a flange at the other end, and which flange is pressfitted around the flange of the second cylinder 121. A terminal 57 is secured to the outer peripheral surface of the cylindrical member 131 of the collector 130.

The provision of the collector 130 in place of the collector 30 of FIG. 1 permits to make smaller a space in the axial hollow portion 8 in the movable contact 7. In this case, however, case should be taken to the position of opening 45 serving as gas bleeding means. In other words, if the suction chamber is brought closer to the compressure chamber 18, and a communicating hole 45 is provided in the peripheral wall of the second cylinder 121 for bleeding gas from the suction chamber into a vessel, soon after or simultaneously when the fixed contact 6 is drawn out of the throat portion 42 in the insulating nozzle 38, then there arises a possibility of the communicating hole 45 overlapping the first cylinder 11, in the case of a circuit breaker wherein a distance between contacts is considerably long. In such a case, gas acting on an arc in the suction chamber directly impinges on the inner surface of the first cylinder 11, thereby damaging the aforesaid inner surface. The inner surface of the first cylinder 11 should provide a smooth sliding surface for the first piston 115, and hence a damage on the aforesaid inner surface should be prevented.

With the embodiment shown in FIGS. 7 and 8, the openings 45 is provided in the peripheral wall of the second cylinder 121 as far from the closed end 122 of the second cylinder 121 as possible. The second piston 125 is fitted in the second cylinder 121 sealingly slidingly. The second piston 125 is integrally secured to the movable contact 7 on a side opposite to the free end portion of the contact 7. As shown in FIG. 8, the second piston 125 is formed with a stepped portion 191 on a side opposed to the substantially closed end portion 122 of the second cylinder 121, while the inner surface of the substantially closed end of the second cylinder 121 on a side opposed to the second piston 125 is formed with a stepped portion 192 which faces the stepped portion of the second piston. The stepped portions 191 and 192 define a suction chamber 126 extending in the direction of the movable contact 7 moving away from the fixed contact.

Thus, according to the provision of the suction chamber 126 which may extend or may be enlarged in the direction away from the fixed contact 6, the openings 45 for bleeding gas from the suction chamber into the vessel therethrough can be positioned apart from the substantially closed end portion 122 of the second cylinder 21, soon after or simultaneously when the fixed contact 6 is drawn out of the throat portion 42 in the insulating nozzle 38. Accordingly, gas being bled from the suction chamber 126 through the opening 45 into a space in the vessel may be prevented from impinging on the inner surface of the first cylinder 11.

Figure 9:
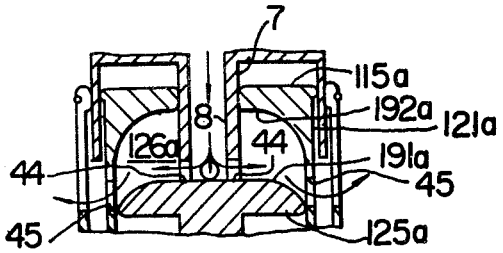
FIG. 9 is a partial cross-sectional view of a modification of the embodiment of FIG. 7.

FIG. 9 is a modification of the embodiment of FIG. 7, with the similar parts designated same reference numerals in common with those given in FIG. 1. As shown in FIG. 9, a back side of a first piston 115*a* is formed with a convex surface 192*a* which is divergent in the direction to open a path. A second piston 125*a* is provided with a convex surface 191*a* complementary to the concave surface 192*a*. As a result, there is provided a suction chamber 126*a* having curved surfaces extending along the flow of gas between the openings 44 provided in the peripheral wall of the movable contact 7 and openings 45 provided in the peripheral wall of the second cylinder 121*a*. When the suction chamber 126*a* is communicated with a space in the contact 7 through the above openings, then gas may be smoothly discharged from the suction chamber 126*a* through the axial hollow portion 8 provided in the contact 7 into a space in the vessel.

Figure 10:
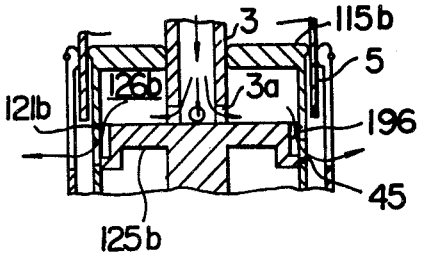
FIG. 10 is a partial cross-sectional view of another modification of the embodiment of FIG. 7, in its open circuit condition.

FIG. 10 shows another modification of the embodiment of FIG. 7, with the similar parts designated same reference numerals in common with those given in FIG. 7.

As shown in FIG. 10, the back surface of a first piston 115 and the surface of a second piston in opposed relation thereto are flat, while slits 196 are provided in the outer periphery of the second piston 125*b*. The slits 196 extend in the direction to open a path and adapted to be closed with the inner peripheral surface of the second cylinder 121*b* at the initial stage, and to face a communicating holes 45. In this case, an empty volume of the slits 196 will be a dead volume for a suction chamber 126*b*. In case such a dead space can not be neglected, then as shown in FIG. 8 projecting portions may be provided on the back surface of the second piston so as to fit in the slits 196.

Figure 11:
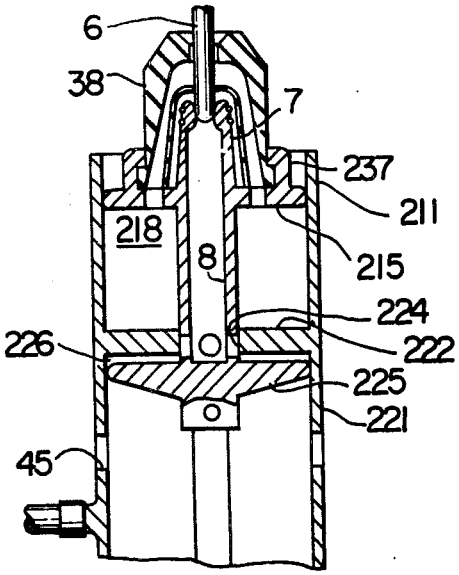
FIG. 11 is a partial cross-sectional view of a still further embodiment of the invention, in its open circuit condition.

FIG. 11 shows still another embodiment of the present invention, wherein a first piston is movable and a first cylinder is fixed. In this case, as well, the similar parts are designated same reference numerals in common with those of FIG. 1. As in FIG. 1, a second cylinder 22 is secured to a vessel through the medium of a cylindrical insulating member. A first cylinder 21 is continuous through the medium of a common, substantially closed end 222, with a second cylinder 221 in opposed relation. The common, substantially closed end 223 has an opening 224 in its center, while a movable contact 7 is slidably sealingly fitted in the opening 224. A first piston 215 which is slidably fitted in the first cylinder 211 is integrally connected to a movable contact 7 which extends through the center of the piston 215. A compression chamber 218 is defined by the inner peripheral surface of the first cylinder 211, the common, substantially closed end 222, first piston 215, and the outer peripheral surface of the movable contact 7.

The first piston 215 is formed with an annular flange 237 on the side opposite to the compression chamber 218, while an insulating nozzle 381 is secured to the annular flange 237 in a manner to surround the free end portion of the movable contact 7, as in FIG. 1.

A second piston 225 is integrally connected to the movable contact 7 at an end opposite to the free end thereof and slidably fitted in a second cylinder 221. Thus, a suction chamber 226 is defined by the common, substantially closed end 222, the inner peripheral surface of the second cylinder 221, the second piston 225, and the outer peripheral surface of the movable contact 7.

As described above, the first cylinder defining the compression chamber should not necessarily be connected to the movable contact. It is to be understood that a suction chamber can be defined as that the second cylinder is connected to the movable contact and the second piston is fixed, although in FIGS. 1 and 2 the second cylinder defining the suction chamber is secured to a vessel.

Figure 12:
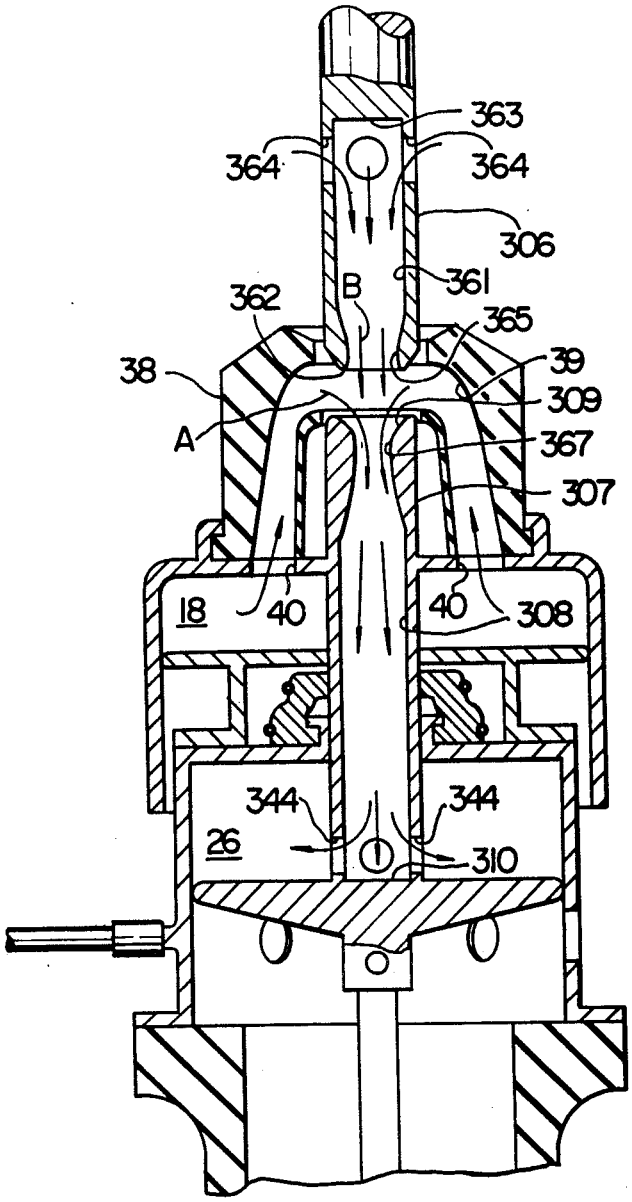
FIG. 12 is a partial cross-sectional view of a yet further embodiment of the invention in its open circuit condition.

FIG. 12 shows still another embodiment of the invention, in which an axial hollow portion is provided in a fixed contact, with the similar parts designated same reference numerals in common with those given in FIG. 1.

As shown in FIG. 2, a fixed contact 306 is provided with an axial hollow portion 361 running therethrough. The axial hollow portion 361 has an open end 362 and a closed end 363, while an opening 364 is provided in a peripheral wall of the fixed contact 361 adjacent to the closed end 363, in a manner that the axial hollow portion 361 is communicated through the openings 364 with a space in the vessel. The axial hollow portion 361 has a throat portion 365 adjacent to the open end 362 thereof.

A movable contact 307 is provided with an axial hollow portion 308 running therethrough. The axial hollow portion 308 has an open end 309 close to the fixed contact 306, and a closed end 310 away from the fixed contact 306. Openings 344 are provided in the peripheral wall of the movable contact 307 adjacent to the closed end 310. The axial hollow portion 308 is communicated through the openings 344 with the suction chamber 26. The axial hollow portion 308 is formed with a throat portion 367 adjacent to its open end. The throat portion 367 of the axial hollow portion 308 in the movable contact 307 has a diameter smaller than that of the throat portion 356 of the axial hollow portion 361 in the fixed contact 306.

In operation, when the movable contact 308 moves in the direction away from the fixed contact 306, then an extinguishing gas in the compression chamber is compressed, while a volume of the suction chamber 26 is enlarged. A pressure difference between the compression chamber 18 and the suction chamber 26 causes an arc extinguishing gas to be directed from the compression chamber 18 via openings 40, guide passage 39 and axial hollow portion 308, into the suction chamber 26. On the other hand, an increase in volume of the suction chamber 26 causes an arc extinguishing gas to be introduced from the vessel, via openings 364 provided in the peripheral wall of the fixed contact 306 and axial hollow portion 361, into the suction chamber 26. A gas stream flowing from the compression chamber 18 via guide passage 39 into the axial hollow portion 308 in the movable contact 307, and a gas stream flowing from a space in the vessel via openings 364 and axial hollow portion 361 in the fixed contact 306 blow off an arc produced between the contacts 306 and 307.

FIG. 12 shows gas steams produced in the initial phase of an opening operation of the contacts.

As shown in FIG. 3, an initial pressure build-up in the compression chamber 18 is slow. On the other hand, a sharp pressure drop takes place in the suction chamber 26. For this reason, in the initial phase of an opening operation of the both contacts, there are formed a gas stream A directed from the compression chamber 18 towards the suction chamber 26, and another gas stream B directed from the hollow portion in the hollow fixed contact 1 towards the suction chamber 26. These gas streams flow through the axial hollow portion 308 in the movable contact 307. More particularly, gas streams A and B join together at the tip of the movable contact, which is opposed to the fixed contact, and then flow into the suction chamber 26.

Figure 13:
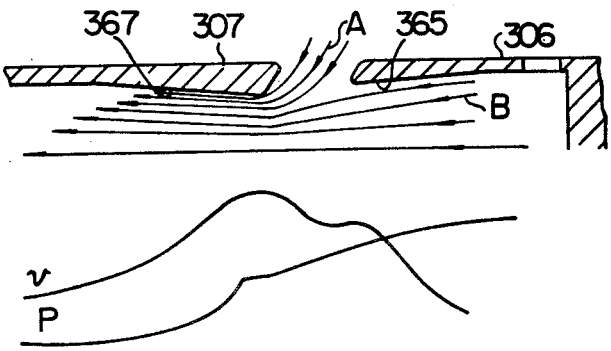
FIG. 13 is a flow-velocity-versus-pressure characteristics of an arc extinguishing gas flow between contacts in the circuit breaker of FIG. 12.

FIG. 13 is an enlarged view of the neighborhood of the contacts 306, 307, showing a pressure distribution P of gas in the initial phase of an opening operation of the contacts and a flow velocity distribution v. FIG. 13 refers to an initial phase of an opening operation of the contacts. In this figure, a gas stream A from the compression chamber affords little pressure rise, and hence is purged therefrom merely according to the compression of a compression chamber. Accordingly, a pressure of gas stream A becomes almost the same level as that of the gas stream B. The pressure distribution P and flow velocity ditribution v are those taken along the axis of the contacts.

Referring to the flow velocity distribution v, the diameter of the throat portion 367 on a side of the movable contact 307, which is opposed to the fixed contact, is reduced, and the flow velocity is maximized in the throat portion 367. This fact that the flow velocity peaks at the throat portion 367 is advantageous in shortening an arcing time according to the effect of the suction chamber 26, during the time until the fixed contact 306 is drawn out of the insulating nozzle 38. As best shown in the pressure distribution P, the diameter of the throat portion 365 of the fixed contact 306 is larger than the diameter of the throat portion 367 of the movable contact 307, so that a pressure of gas stream B in a clearance between the contacts remains almost unchanged when joining the gas stream A. As a result, a pressure of an arc extinguishing gas is built up between the fixed contact and the movable contact, with an accompanying increase in density of an arc extinguishing gas being blown against an arc, so that an arc extinguishing effect is enhanced. In addition, in case a pressure of gas between the contacts is built up, an insulation resistance-voltage-withstanding characteristic between contacts is enhanced, thereby insuring positive current interruption in a region, wherein a distance between the contacts is short.

Figure 14:
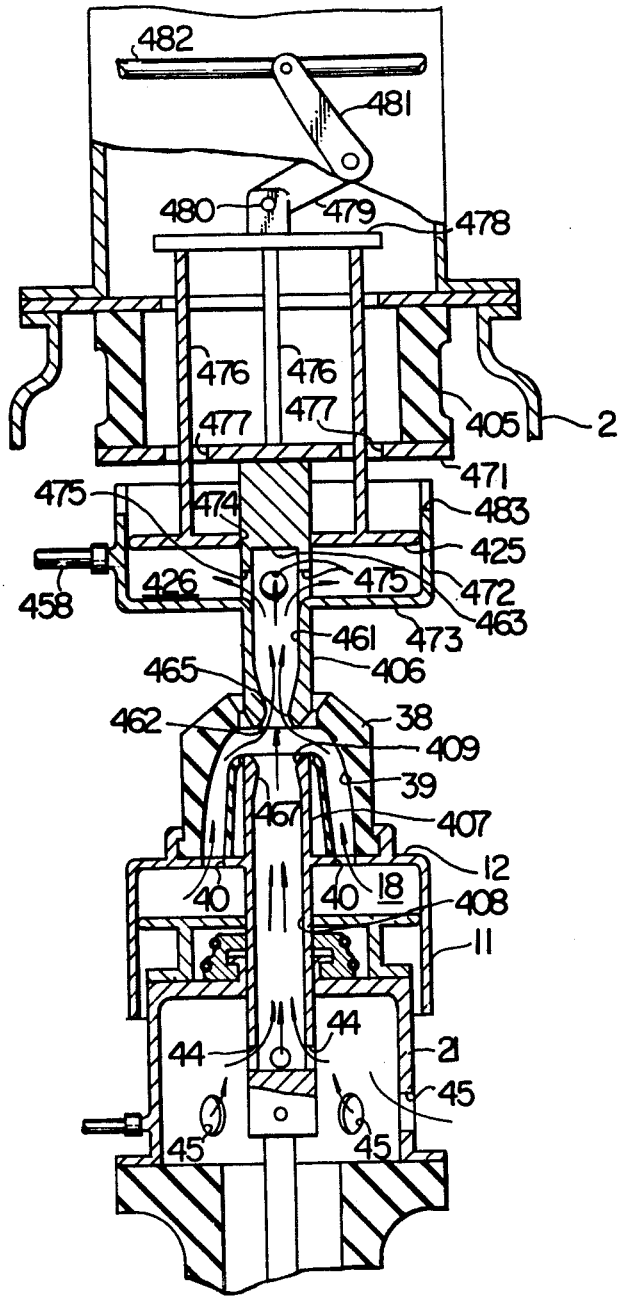
FIG. 14 is a partial cross-sectional view of a further embodiment of the invention, in its open circuit condition.

FIG. 14 is still another embodiment of the invention, in which a suction chamber cooperates with a fixed contact, with the similar parts designated same reference numerals in common with those given in FIG. 1.

A fixed contact 406 is secured through the medium of a fixing disc 471 and tubular insulating body 405 to a vessel 2. The fixed contact 406 has an axial hollow portion 461 running therethrough. The axial hollow portion 461 has an open end 462 on a side close to the movable contact 407, and a closed end 463 away from the movable contact 407. A third cylinder 472 has a closed end 473, while a fixed contact 406 is secured to the third cylinder 472 in a manner that the fixed contact 406 pierces through the closed end portion 473 in concentric relation thereto. The third cylinder 472 is coupled to a terminal on an outer periphery of the cylinder 472.

A second piston 425 is slidably fitted in the third cylinder 472. The second piston 425 is provided with a hole 474 in its center, while the fixed contact 406 is fitted in the hole 474 sealingly. Thus, the suction chamber 426 is defined by the closed end 473 of the third cylinder 472, second piston 425, inner peripheral surface of the third cylinder, and outer peripheral surface of the fixed contact 406. Openings 475 are provided in the peripheral wall of the fixed contact 406 with the axial hollow portion 461 in the fixed contact 406 and suction chamber 426 being communicated with each other.

Connecting members 476 are integrally secured to the second piston 425 at an equal spacing around the second piston on a side opposite to the suction chamber 426. The connecting members 476 extend through holes 477 provided in the fixed disc 471 and terminate at the disc 478. The disc 478 is secured through the medium of a pin 480 to an arm 479 of a 'L' shaped link, while the other arm 481 is pivoted to a driving rod 482. The driving rod 482 is coupled to an actuator not shown. The actuator is operated in synchronism with another actuator which is not shown but drives the movable contact 407. Alternatively, the movable contact 407 and second piston 425 may be driven by a single common actuator.

In operation, when the movable contact 407 is moved in the direction away from the fixed contact 406, then an arc extinguishing gas is compressed in the compression chamber 18, and a volume of the suction chamber 426 is enlarged. A difference in pressure between the compression chamber 18 and the suction chamber 426 causes an arc extinguishing gas to be directed from the compression chamber 18 through the openings 40 provided in the substantially closed end portion 12 of the first cylinder 11, and the guide passage 39 into the axial hollow portion 461 in the fixed contact 406, and then through the opening 475 into the suction chamber 426. When a volume of the suction chamber 426 is enlarged, then an arc extinguishing gas in a space in the vessel 2 flows through the opening 45 provided in the peripheral wall of the second cylinder 21 and opening 44 provided in the peripheral wall of the movable contact 407 into the axial hollow portion 408 in the movable contact 407, and then through the axial hollow portion 461 in the fixed contact 406 into the suction chamber 426.

Cut-away portion 483 provided in the peripheral wall of the third cylinder is so positioned that the suction chamber 426 may be communicated through the cut-away portion 483 with a space in the vessel, soon after or simultaneously when the fixed contact 406 is drawn out of the throat portion 42 of the insulating nozzle 38.

As in the case of FIG. 12, the axial hollow portion 461 in the fixed contact 406 is formed with a throat portion 465 in the close vicinity of its open end 462, while the axial hollow portion 408 in the movable contact 407 is formed with a throat portion in the close vicinity of its open end 409. In this respect, it is preferable that the diameter of the throat portion 465 of the fixed contact be smaller than that of the throat portion 467 of the movable contact, thereby preventing a pressure drop.

Figure 15:
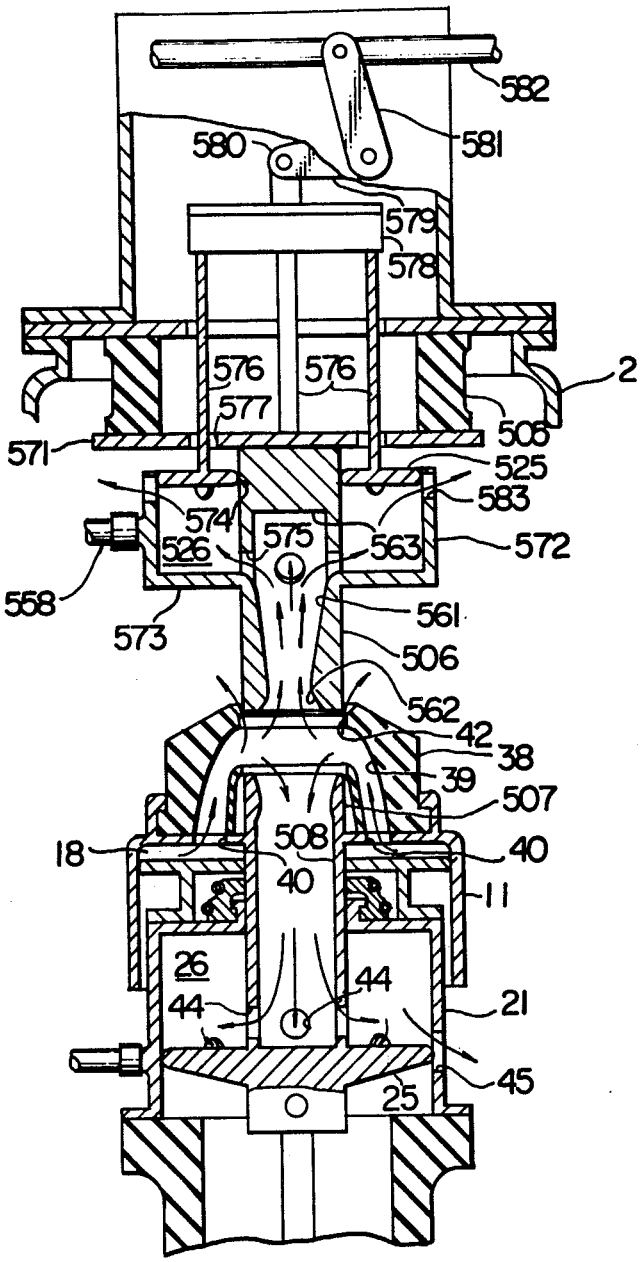
FIG. 15 is a partial cross-sectional view of a further embodiment of the invention, in its open circuit condition.

FIG. 15 shows still an other embodiment of the invention, in which the fixed contact and movable contact cooperate with the suction chamber, with the similar parts designated same reference numerals in common with those given in FIG. 1.

In FIG. 15, a fixed contact 506 which is secured through the medium of a tubular insulating member 505 and fixing disc 571 to a vessel 2. The fixed contact 506 includes an axial hollow portion 561 therein. The axial hollow portions 561 has an opening 562 on the side of the movable contact 507, and a closed end 563 on the side away from the movable contact 507. A third cylinder 572 has a closed end 573 thereof, and the fixed contact 506 is integrally secured to the third cylinder 572 in a manner that the fixed contact 506 extends through the closed end 573 of the cylinder 572 in concentric relation therewith. The third cylinder 572 has connected thereto a terminal 558.

A third piston 525 is slidably fitted in the third cylinder 572. The third piston 525 has an opening 574 in its center, with the fixed contact 506 slidably sealingly fitted in the central opening 574. A second suction chamber 526 is defined by the inner peripheral surface of the third cylinder 572, the outer peripheral surface of the fixed contact 506, a closed end 573 of the third cylinder, and third piston 525. Openings 575 are provided in the peripheral wall of the fixed contact 506, so that the axial hollow portion 561 in the fixed contact 506 may be communicated with the second suction chamber 526.

Integrally secured to the third piston 525 on the side opposite to the second suction chamber 526 are connecting members 576, only three of which are shown, and are arranged at an equal angular spacing around the fixed contact 506. The connecting members 576 extend through apertures 577 provided in the fixing disc 571, terminate at the disc 578, and are secured to the disc 578. The disc 578 is pivotally connected to one arm 579 of a 'L' shaped link by means of a pin 580. The other arm 581 of the 'L' shaped link is pivotally connected to a driving rod 582. The driving rod 582 is coupled to an actuator not shown. This actuator may be operated in synchronism with an actuator (not shown) for driving the second piston 25. Alternatively, the second and third piston 25, 525 may be driven by a single common actuator.

In operation, when the movable contact 7 is moved away from the fixed contact 506, an arc extinguishing gas in the compression chamber 18 is compressed, whereupon the volumes of the first and second suction chambers 26 and 526 are enlarged. An arc extinguishing gas in the compression chamber 18 is directed, on one hand, via holes 40 provided in the substantially closed end 12 of the first cylinder 11, guide passage 39, axial hollow portion 508, and openings 44 in the movable contact 507, into the first suction chamber 26 and then through openings 45 provided in the peripheral wall of the second cylinder 21 into the space in the vessel 2. The arc extinguishing gas, on the other hand, is directed via the holes 40 in the substantially closed end 12 in the first cylinder 11, guide passage 39, axial hollow portion 561 in the fixed contact 506, and openings 575 into the second suction chamber 526 and via cut-away portions 583 provided in the peripheral wall of the third cylinder 572 into the space in the vessel 2. It is needless to mention that the openings 45 provided in the peripheral wall of the second cylinder 11, and cut-away portions 583 provided in the peripheral wall of the third cylinder 572 are so positioned that the suction chambers 26 and 526 may be communicated with or opened to a space in the vessel through the openings 45 and cut-away portions 583, respectively, soon after or simultaneously when the fixed contact 506 is draw out of the throat portion 42 in the insulating nozzle 38.

As has been described earlier, the suction chamber may be opened, simultaneously when one of the contacts is drawn out of a throat portion in an insulating nozzle, so that the suction effect of the suction chamber at the initial stage may be thoroughly utilized, and the flow of a gas stream is not hindered. Unlike a suction chamber of the type which is not opened in this manner, a gas stream which is produced due to a pressure difference between a compression chamber and an ambient gas may be maintained after the suction chamber has been opened. In this manner, pressure build-up in a suction chamber is suppressed, thereby improving an interrupting performance of a breaker.

What is claimed is:

1. A puffer type gas-blast circuit breaker including at least one interrupting unit mounted in a vessel filled with an arc extinguishing gas of an unitary pressure, said interrupting unit comprising:

a pair of contacts positioned in alignment with but in opposed relation to each other, and movable toward and away from each other respectively, at least one of said pair of contacts having therein an axial hollow portion, said axial hollow portion having an opening in that axial free end face of said one contact, which is opposed to the other contact, whereby an arc is established between said pair of contacts, upon disengagement of said pair of contacts from each other;

a first cylinder and a first piston within said first cylinder to define a compression chamber filled with an arc extinguishing gas, said first cylinder and piston being movable relative to each other in association with the relative movement of said pair of contacts;

an insulating nozzle encompassing a free end portion of said one contact and having a throat portion in alignment with said pair of contacts, said throat portion being capable of being substantially blocked by the other contact, said insulating nozzle having an inner peripheral surface to define a guide passage by the cooperation of the free end portion of said one contact, and said guide passage bringing said compression chamber into communication with said axial hollow portion through said opening, when said pair of contacts are disengaged from each other;

a second cylinder and a second piston within said cylinder to define a suction chamber, said second cylinder and piston being movable relative to each other in association with the relative movement of said pair of contacts;

a first communicating means for bringing said axial hollow portion in communication with said suction chamber, whereby when said pair of contacts are relatively moved away from each other, an arc extinguishing gas in said compression chamber is compressed, and a volume of said suction chamber is enlarged, and when said pair of contacts are disengaged from each other, a pressure difference between said compression chamber and said suction chamber causes said arc extinguishing gas to be directed from said compression chamber via said guide passage, said axial hollow portion and said first communicating means, into said suction chamber, thereby to be blown against an arc produced between said pair of contacts; and gas bleeding means for bleeding an arc extinguishing gas from said suction chamber into a space in said vessel by bringing said suction chamber into an open condition to or communication with a space in said vessel, when said pair of contacts are moved a given distance in the directions away from each other.

2. A puffer type gas-blast circuit breaker as set forth in claim 1, wherein said gas bleeding means causes said suction chamber to be communicated with said space in said vessel, almost simultaneously when said other contact is drawn out of a throat portion in said insulating nozzle.

3. A puffer type gas-blast circuit breaker as set forth in claim 2, wherein said gas bleeding means has at least one opening provided in the peripheral wall of said second cylinder, said opening is so positioned that said second piston is brought into register with said opening, almost simultaneously when said other contact is drawn out of a throat portion in said insulating nozzle.

4. A puffer type gas-blast circuit breaker as set forth in claim 2, wherein said bleeding means has a space continuous with said suction chamber and a diameter larger than that of said suction chamber, said space being communicated with a space in said vessel, a joint portion of said suction chamber to said space being so positioned that said second piston may reach said joint portion, simultaneously when said other contact is drawn out of a throat portion in said insulating nozzle.

5. A puffer type gas-blast circuit breaker as set forth in claim 2, wherein said gas bleeding measn has at least one opening provided in said second piston in a manner to extend therethrough, an elongated member secured to said second cylinder and slidably sealingly fitted in said opening in said second piston, and said elongated member extending in the axial direction of said piston, whereby said opening in said second piston is blocked by said elongated member, when said pair of contacts are brought into engagement with each other, and said elongated member is so positioned in the axial direction of said piston that said elongated member may be drawn out of said opening in said second piston, simultaneously when said other contact is drawn out of a throat portion in said insulating nozzle.

6. A puffer type gas-blast circuit breaker, as set forth in claim 1, wherein said pair of contacts, said first piston, said first cylinder, said second piston, and said second cylinder are arranged in coaxial relation, said first cylinder having a substantially closed end portion, said one contact being secured to said first cylinder by piercing through the substantially closed one portion of said first cylinder, said second cylinder having an opening provided at its closed end, one contact being slidably sealingly fitted in an opening at its closed end of said second cylinder, and the closed end of said second cylinder defining said first piston.

7. A puffer type gas-blast circuit breaker as set forth in claim 6, wherein said breaker further includes a collector which has two or more axially extending contacting pieces that are positioned at an equal spacing around said second cylinder in the circumferential direction thereof, said contacting pieces each having one end which is urged against and engaged with the outer peripheral surface of said first cylinder, and the other end secured to said second cylinder.

8. A puffer type gas-blast circuit breaker as set forth in claim 7, wherein said suction chamber is divergent in the direction away from said other contact.

9. A puffer type gas-blast circuit breaker as set forth in claim 8, wherein that side of an closed end portion of said second cylinder, which is opposed to said second piston, is provided with stepped surfaces, while that side of said second piston, which is opposed to said closed end portion of said second cylinder, is provided with stepped surfaces complementary to said firstly referred stepped surfaces.

10. A puffer type gas-blast circuit breaker as set forth in claim 8, wherein that side of an closed end portion of said second cylinder, which is opposed to said second piston, is provided with a curved surface, while that side of said second piston, which is opposed to the closed end portion of said second cylinder, is provided with a curved surface complementary to the firstly referred curved surface.

11. A puffer type gas-blast circuit breaker as set forth in claim 7, wherein said second piston has at least one axial open-slit on its peripheral surface, said open-slit having one axial end which is open to the surface of said second piston, which is opposed to said second cylinder, and an axial other end which is closed.

12. A puffer type gas-blast circuit breaker as set forth in claim 1, wherein said pair of contacts, said first piston, said first cylinder, said second piston and said second cylinder are arranged in coaxial relation, said first and second cylinders being secured to each other through the medium of a single common end portion, said common end portion having a hole therein, with said one contact being slidably sealingly fitted in said hole in said common end portion.

13. A puffer type gas-blast circuit breaker as set forth in claim 1, wherein said other contact has an axial hollow portion running therethrough, an axial hollow portion in said other contact having an opening in an axial one end of said other contact, which is opposed to said one contact.

14. A puffer type gas-blast circuit breaker as set forth in claim 13, wherein an axial hollow portion in said one contact has a throat portion adjacent to its open end, and an axial hollow portion in said other contact has a throat portion adjacent to its open end, said throat portion in said one contact having a diameter smaller than that of a throat portion in said other contact.

15. A puffer type gas-blast circuit breaker as set forth in claim 13, wherein said breaker further includes: a third cylinder, a third piston fitted therein and defining a second suction chamber therein, said third piston and said third cylinder being relatively movable in association with the relative movement of said pair of contacts; a second communicating means for bringing said axial hollow portion in said other contact into communication with said second suction chamber;

whereby when said pair of contacts are moved in the direction away from each other, a volume of said second suction chamber is enlarged, and a pressure difference between said compression chamber and said second suction chamber causes are arc extinguishing gas to be directed from said compression chamber, via said guide passage, said axial hollow portion in said other contact, and said second communicating means, into said second suction chamber to be blown against an arc produced between said pair of contacts; and a second gas bleeding means for bleeding an arc extinguishing gas from said second suction chamber into a space in said vessel by bringing said second suction chamber into or communication with a space in said vessel, when said pair of contacts are moved a given distance.

16. A puffer type gas-blast circuit breaker as set forth in claim 15, wherein said first gas bleeding means and said second gas bleeding means are operated substantially when said other contact is drawn out of a throat portion in said insulating nozzle, thereby bringing said suction chamber communicated with the axial hollow portion in said one contact and said second suction chamber communicated with an axial hollow portion in said other contact, into communication with a space in said vessel.

* * * * *